US009856870B2

(12) United States Patent
Chevallier

(10) Patent No.: US 9,856,870 B2
(45) Date of Patent: Jan. 2, 2018

(54) HYDRAULICALLY CONTROLLED DIAPHRAGM PUMP COMPRISING A DEDICATED DEGASSING PATH

(71) Applicant: MILTON ROY EUROPE, Pont Saint Pierre (FR)

(72) Inventor: Yoann Chevallier, Malaunay (FR)

(73) Assignee: Milton Roy Europe, Pont-Saint-Pierre (FR)

( * ) Notice: Subject to any disclaimer, the term of this patent is extended or adjusted under 35 U.S.C. 154(b) by 265 days.

(21) Appl. No.: 14/722,683

(22) Filed: May 27, 2015

(65) Prior Publication Data

US 2015/0345488 A1 Dec. 3, 2015

(30) Foreign Application Priority Data

May 27, 2014 (FR) ..... 14 54797

(51) Int. Cl.

| | |
|---|---|
| ***F04B 53/06*** | (2006.01) |
| ***F04B 53/10*** | (2006.01) |
| ***F04B 53/14*** | (2006.01) |
| ***F04B 43/067*** | (2006.01) |

(52) U.S. Cl.

CPC ..... *F04B 53/06* (2013.01); *F04B 43/067* (2013.01); *F04B 53/1037* (2013.01); *F04B 53/14* (2013.01)

(58) Field of Classification Search

CPC .... F04B 43/06; F04B 43/067; F04B 53/1037; F04B 53/06

USPC ..... 417/385, 388, 435

See application file for complete search history.

(56) References Cited

U.S. PATENT DOCUMENTS

| | | | | |
|---|---|---|---|---|
| 5,244,360 | A | 9/1993 | Lefebvre | |
| 6,086,340 | A * | 7/2000 | Edwards | F04B 43/067 417/413.1 |
| 7,665,974 | B2 * | 2/2010 | Hembree | F04B 43/0081 417/385 |
| 2011/0280747 | A1 * | 11/2011 | Lefebvre | F04B 43/0081 417/395 |

FOREIGN PATENT DOCUMENTS

| | | |
|---|---|---|
| CN | 101037992 | 9/2007 |
| EP | 2 670 537 | 6/1992 |
| EP | 2 934 332 | 1/2010 |
| EP | 2 394 056 | 12/2011 |

* cited by examiner

*Primary Examiner* — Patrick Hamo
*Assistant Examiner* — Chirag Jariwala
(74) *Attorney, Agent, or Firm* — Muncy, Geissler, Olds & Lowe, P.C.

(57) ABSTRACT

The invention relates to a pump comprising a dosage head (1) comprising a first part (2) and a second part (7) in which there is provided a hydraulic chamber (8) which is filled with a fluid and a dosage body (14) comprising means for driving a piston (13) of the pump in translation in the hydraulic chamber, a valve (17) for regularization of pressure in the hydraulic chamber, and at least one degassing path (33, 34, 36, 37) which extends in the second part, such that a first end of the path which forms the lowest point of the said path opens out at a junction between the piston and a seal fitted on the piston, and a second end of the path which forms the highest point of the said path opens out into a hollow body of the said valve.

9 Claims, 2 Drawing Sheets

HYDRAULICALLY CONTROLLED DIAPHRAGM PUMP COMPRISING A DEDICATED DEGASSING PATH

The invention relates to a hydraulically controlled diaphragm pump comprising a dedicated degassing path.

TECHNOLOGICAL BACKGROUND OF THE INVENTION

Hydraulically controlled diaphragm pumps usually comprise a dosage head comprising a first part with a pumping chamber and a second part in which there is provided a hydraulic chamber which is filled with a hydraulic control fluid, and is separated from the pumping chamber by a diaphragm; as well as a dosage body comprising means for driving a piston of the pump in translation in the hydraulic chamber according to a given axis of translation.

It is common to equip the said pumps with a valve for regularization of pressure in the hydraulic chamber, in order in particular to avoid any damage to the diaphragm or blockage of the pump. The said valve is typically arranged in the vicinity of a highest point of the hydraulic chamber in the position of work of the pump, and comprises a hollow body which is in communication with the hydraulic chamber via a calibrated flap valve, the flap valve opening, when the pressure in the hydraulic chamber exceeds a threshold pressure, in order to discharge part of the fluid from the hydraulic chamber to the hollow body of the valve.

In addition, the valve can permit degassing of the air bubbles which are present in the hydraulic chamber.

However, the degassing is found to be limited because of the fact in particular of the reduced cross sections of the channels which connect the hydraulic chamber to the hollow body of the valve. In certain cases, bubbles can therefore remain wedged in the hydraulic chamber or in the channels which connect the said chamber to the hollow body of the valve. This is the case for example for pumps in which the dosage body is filled with air, thus giving rise to slight intake of air into the hydraulic chamber at each movement of translation of the piston, and thus to a relatively high concentration of bubbles in the hydraulic chamber.

However, the presence of air bubbles in the fluid in the hydraulic chamber and in the channels in connection with the hydraulic chamber tends to downgrade considerably the performance of the pumps, thus giving rise in particular to a substantial loss of their output. This disadvantage is increased further for pumps with small outputs.

SUBJECT OF THE INVENTION

An objective of the invention is to propose a hydraulically controlled diaphragm pump which can permit continuous and substantial degassing of the gases which are present in the hydraulic control fluid.

BRIEF DESCRIPTION OF THE INVENTION

In order to achieve this objective, a hydraulically controlled diaphragm pump is proposed comprising:

- a dosage head comprising a first part with a pumping chamber, and a second part in which there is provided a hydraulic chamber which is filled with a hydraulic control fluid, and is separated from the pumping chamber by a diaphragm;

- a dosage body comprising means for driving a piston of the pump in translation in the hydraulic chamber according to an axis of translation;
- at least one seal arranged on the piston at a junction between the second part and the dosage body;
- a pressure regularization valve which is arranged in the vicinity of a highest point of the hydraulic chamber in the position of work of the pump, the valve having a hollow body which is in communication with the hydraulic chamber via a flap valve which opens in the direction of the hydraulic chamber towards the hollow body;
- degassing means which are dedicated to the fluid, the said means comprising at least one degassing path which extends in the second part in a manner which is non-parallel to the axis of translation, such that a first end of the path which forms the lowest point of the said path opens out at a junction between the piston and the seal, and a second end of the path which forms the highest point of the said path opens out into the valve body above the flap valve.

Thus, the pump comprises a dedicated degassing path which is placed as close as possible to the frontier between the dosage body and the second part. The air which passes from the dosage body to the second part at each movement of translation of the piston is therefore easily discharged to the hollow body of the valve. This permits continuous and substantial degassing of the pump.

This also limits the transfer of air bubbles from the dosage body to the hydraulic chamber. The quantity of air bubbles in the hydraulic chamber thus remains limited or non-existent.

The performance of the pump is thus very high, and its performance is constant over time.

The invention is particularly suitable for pumps with low outputs since they are more sensitive to the presence of air in their hydraulic chamber.

It will be appreciated that in the present application, the terms "high point", "low point", "lower", "higher", and "above" etc. are to be understood with reference to the position of the pump in service, i.e. the position in which the pump is supported on a support, and the valve is arranged such as to extend in the direction opposite this support.

BRIEF DESCRIPTION OF THE DRAWINGS

The invention will be better understood in the light of the following description of a particular, non-limiting embodiment of the invention. Reference will be made to the accompanying figures, in which.

DETAILED DESCRIPTION OF THE INVENTION

Figure 1:
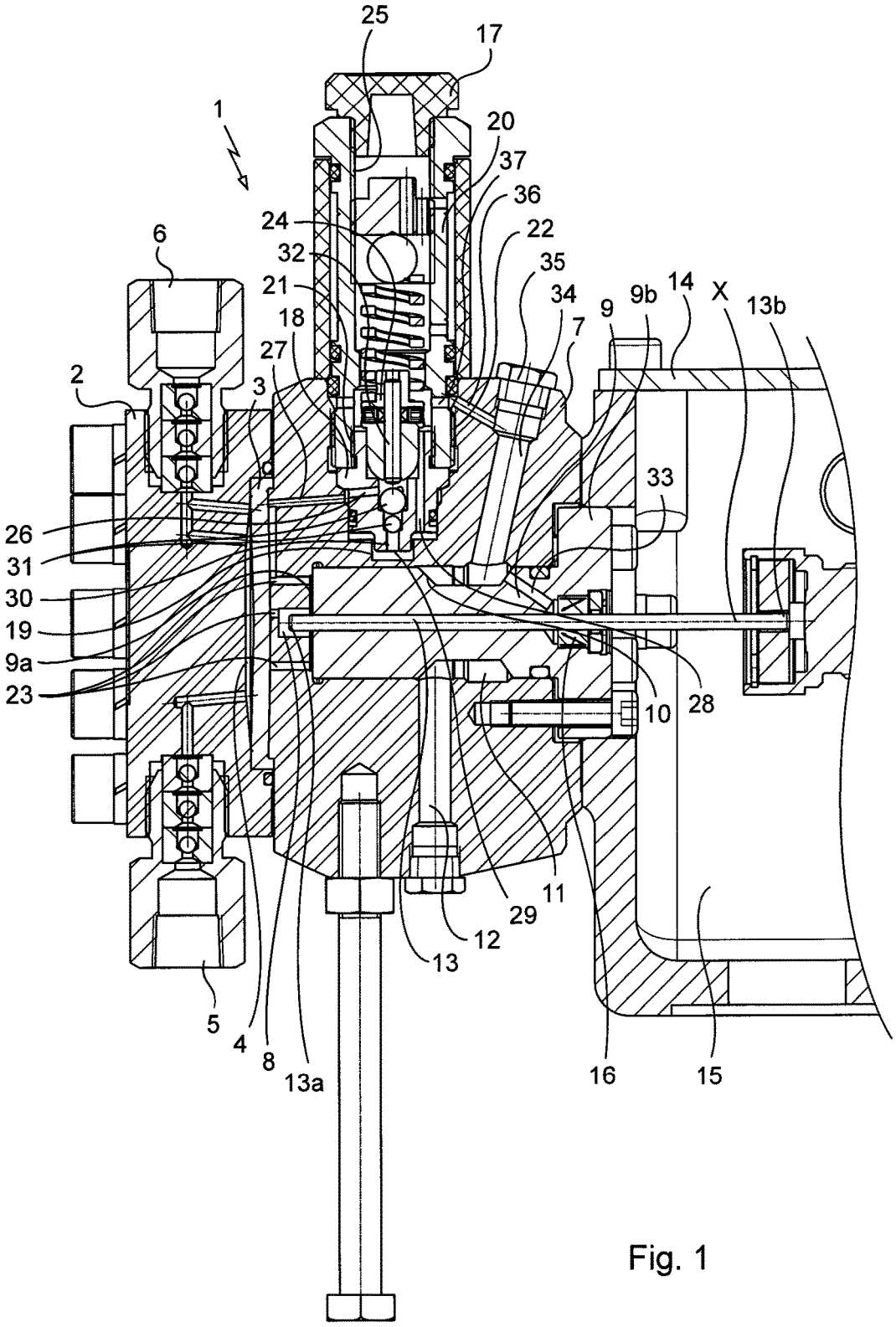
FIG. 1 is a view in cross section of a hydraulically controlled diaphragm pump according to the invention, only part of the dosage body being represented.

With reference to FIG. 1, the hydraulically controlled diaphragm pump according to the invention is in this case a pump with a low output and medium or high pressure.

The pump comprises a dosage head 1 comprising a first part 2 which defines a pumping chamber 4 together with a diaphragm 3 of the pump. The pumping chamber 4 is connected to the exterior by a suction channel 5 and a delivery channel 6 which are equipped with one-way flap valves contained in flap valve cases.

The diaphragm 3 is in this case a thick diaphragm. The diaphragm 3 is resiliently deformable from its form at rest (the form represented) which corresponds to its state at the end of the suction course of the pump. The rigidity of this diaphragm 3 is such that the suction power of the pump is defined by the capacity of the diaphragm 3 to return by itself to its position of rest. A diaphragm of this type is well known in the prior art, such as for example in application FR 2 934 332 by the applicant, and will not be described in further detail here.

The dosage head 1 additionally comprises a second part 7 in which a hydraulic chamber 8 is provided. The face of the diaphragm 3 opposite that which faces towards the pumping chamber 4 is known as the rear face, and is exposed to the pressure of the hydraulic fluid which exists in the hydraulic chamber 8. Channels 23 for passage of the hydraulic fluid from the hydraulic chamber 8 in order to reach the rear face of the diaphragm 3 are also provided in the second part 7.

The second part 7 also comprises a casing 9 which extends in the second part 7 according to a horizontal axis X such that a first end 9*a* of the casing 9 faces the diaphragm 3, and a second end 9*b* of the casing 9 opens out to the exterior of the second part 7. The casing 9 comprises a local narrowing 10 of its outer cross section, which defines an emptying chamber 11 together with the second part 7.

The second part 7 additionally comprises an emptying channel 12 which connects the said emptying chamber 11 to the exterior of the pump. The emptying channel 12 extends vertically in the second part 7 of the emptying chamber 11 at the lower end of the second part 7.

The pump additionally comprises a piston 13 which is received in the casing 9, and extends according to the said axis X, such that a first end 13*a* of the piston opens out into the hydraulic chamber 8, and a second end 13*b* of the piston 13 opens out of the casing 9.

The piston 13 is driven mechanically in translation by drive means comprising a motor and a drive, which in themselves are known and are not represented in full here, such that the piston 13 can perform a movement of translation in the hydraulic chamber 8 according to the said axis X.

The means for driving the piston 13 in translation are arranged in a dosage body 14 of the pump. More specifically in this case the dosage body 14 comprises a cavity 15 which is adjacent to the second part 7, and in which the second end 13*b* of the piston 13 is connected to the means for driving in translation, the said cavity 15 being in the open air. In this case, the second part 7 is rendered integral with the dosage body 14 by means of the second end 9*b* of the casing 9, thus defining the frontier between the second part 7 and the dosage body 14.

Since the dosage body 14 is filled with air whereas the second part 7 is filled with a hydraulic control fluid, tightness of the second part 7 must be ensured. The pump thus comprises a seal 16 arranged on the piston 13 at a junction between the second part 7 and the dosage body 14. For this purpose, a receptacle is provided in the second end 9*b* of the casing 9, and the seal 16 is arranged in the interior of the said receptacle. The seal 16 is in this case a lip seal.

The pump thus comprises little hydraulic control fluid. In addition, it is possible to dismantle the dosage head 1 easily from the remainder of the pump, since it is not necessary to empty the dosage head 1 or the dosage body 14 beforehand.

The pump additionally comprises a pressure regularization valve 17 in the hydraulic chamber 8.

The valve 17 is in this case arranged on the second part 7 in the vicinity of a highest point of the hydraulic chamber 8 in the position of work of the pump. The valve 17 extends vertically, and comprises a lower portion 18 which is supported in a receptacle 19 provided in the second part 7, above the casing 9, and an upper portion 20 which is supported on the lower portion 18, and extends only partly into the said receptacle 19. In this case, a low end of the upper portion 20 comprises an inner thread 21 for its securing on the lower portion 18, and an outer thread 22 for its securing on the second part 7.

The valve 17 additionally comprises a discharge flap valve 24 which is calibrated. The flap valve 24 is in this case arranged in the valve at the frontier between the lower portion and the upper portion. The flap valve 24 thus delimits a hollow body 25 together with the upper portion 20. The flap valve 24 is configured such as to open in the direction going from the hydraulic chamber 8 towards the hollow body 25, if the pressure in the hydraulic chamber 8 exceeds a threshold value which can be regulated by regulation of the calibration of the flap valve 24, for example by means of a screw. The valve 17 additionally comprises a main channel 26 which is provided in the lower portion 18, in order to open out below the flap valve 24, and is connected to the hydraulic chamber 8 by means of a duct 27 provided in the second part.

Thus, if a blockage occurs in the pumping chamber 4, the hydraulic control fluid contained in the hydraulic chamber 8 can be discharged from the said hydraulic chamber 8 via the main channel 26, then the discharge flap valve 24, in order to open out into the hollow body 25. The valve 17 thus makes it possible to reduce excessive pressure in the hydraulic chamber 8.

In addition, the volume of the hydraulic control fluid which is contained in the hydraulic chamber 8 varies in particular during escape of the fluid from the hydraulic chamber 8 via the flap valve 24, or because of air bubbles which appear during movements of the piston 13 in the hydraulic chamber 8, or because of the variation of the regulation of the course of the pump, which makes the course of the piston 13 vary, and thus the capacity of the pump. In order to eliminate this disadvantage, the valve 17 comprises means for compensation for leakages of the hydraulic control fluid in the hydraulic chamber 8.

In a known manner, the said means comprise a resupply path, which connects the hollow body 25 to the main channel 26, bypassed from the flap valve 24. For this purpose, in this case, the resupply path comprises a first resupply channel 28 which extends vertically through the lower portion 18, between the hollow body 25 and a resupply volume 29 which is delimited by the low end of the lower portion 18 on the one hand, and the corresponding receptacle 19 of the second part 7 on the other hand. The said resupply channel additionally comprises a second channel 30, which extends vertically from the said resupply volume 29 to the main channel 26. The second channel 30 additionally comprises two ball flap valves 31 which are free, one-way and in series, the open direction of these two flap valves 31 being that which goes from the hollow body 25 towards the hydraulic chamber 8.

A rearward course of the piston 13 permits the resilient return of the diaphragm 3 to its position of rest. If this position is reached before the piston 13 has reached its rear dead centre, low pressure occurs in the hydraulic chamber 8, leading to the suction of a volume of the hydraulic fluid drawn from the hollow body 25 through the two flap valves 31 in series. The valve 17 thus makes it possible also to regularize an excessively low pressure in the hydraulic chamber 8.

The valve 17 additionally comprises a venting passage 32 which is arranged bypassed from the flap valve 24, thus permitting continuous venting of the air bubbles which may be present in the hydraulic chamber 8, with the air passing via the main channel 26 and the said venting passage 32, in order to lead to the hollow body. Part of the air bubbles are thus discharged via the main channel 26.

The main channel 26 is arranged above the hydraulic chamber 8, such as to take advantage of the natural accumulation of the air at the high point of the said hydraulic chamber 8, in order to facilitate the venting of the air bubbles contained in the hydraulic chamber 8 in the valve 17.

The pump additionally comprises degassing means which are dedicated to the hydraulic control fluid. The dedicated degassing means comprise a degassing path which extends in the second part 7.

In this case, the degassing path comprises a first channel 33 which extends transversely in the casing 9, such as to open out at its low end at an area of junction between the piston and the seal, and to open out at its high end into the emptying chamber 11. The first channel 33 is thus arranged as close as possible to the area for intake of the air obtained from the dosage body 14, in order to collect the said air. In this case, the first channel 33 thus extends in the direction of the valve 17 and transversely to the axis X.

The degassing path comprises a second channel 34 which extends transversely in the second part 7, such as to open out at its low end into the emptying chamber 11, and at its high end into the open air, thus facilitating its handling. The high end of the second channel 34 is however shut by a stopper 35. The second channel 34 is arranged such as to open out at its low end into the emptying chamber 11, in the upper part of the emptying chamber 11, substantially at the same level as the high end of the first channel 33. The first channel 33 and the second channel 34 are thus connected by means of the emptying chamber 11. Preferably, the second channel 34 is designed such that its low end opens out above the high end of the first channel 33, thereby ensuring a better connection between the two channels, and thus more efficient degassing. In this case, the second channel 34 thus extends in the direction opposite the valve 17, transversely to the axis X.

The degassing path additionally comprises a third channel 36 which extends transversely in the second part 7, such as to open out at its low end into the second channel 34 at the high end of the second channel 34, and at its high end into the receptacle 19 which receives the valve 17. The third channel 36 thus extends in this case in the direction of the valve 17, and transversely to the axis X.

The degassing path additionally comprises a fourth channel 37 which extends through one of the walls of the upper portion 20 of the valve, such as to be connected to a first end of the high end of the third channel 36, and to open out at its second end into the hollow body 25. In this case, the fourth channel 37 extends substantially horizontally.

Thus, the low end of the first channel 33 forms the first end of the degassing path, and is situated at the lowest point of the said path, whereas the second end of the fourth channel 37 forms the second end of the degassing path, and is situated at the highest point of the said path.

When the pump is operating, the air obtained from the dosage body 14 is vented continuously by the degassing path, with the air passing in succession through the first channel 33, the second channel 34, the third channel 36 and the fourth channel 37, in order to open out into the hollow body 25. In addition, the degassing path collects air directly at the seal 16, such that little or no air obtained from the dosage body 14 reaches the hydraulic chamber 8. This prevents degradation of the performance of the pump. In addition, since the degassing path opens out into the upper portion 20 of the valve 17, little or no air is present in the resupply path, which ensures that no bubble, or scarcely any bubble is sent into the hydraulic chamber 8 during a phase of compensation for the leakages of the hydraulic fluid into the hydraulic chamber 8. The dedicated degassing means thus permit very efficient and continuous degassing of the air which is present in the hydraulic fluid.

The degassing path is in this case formed such as to convey the air into the valve 17, by opening out into the valve 17 substantially above the flap valve 24.

Thus, even if the course of the piston 13 were modified, the degassing would always be efficient.

Typically, the degassing path is formed such that the volume of hydraulic fluid contained between the fourth channel 37 (opening out into the valve 17) and the resupply volume 29 is greater than a maximum capacity of the pump.

Preferably, the different channels of the degassing path have a cross section which is larger than the channels which connect the hydraulic chamber 8 to the valve 17 and than the main channel 26. The cross section of the said channels of the degassing path makes it possible to prevent bubbles from remaining wedged in the interior of the said degassing path, with the bubbles to be discharged being more numerous in the degassing path.

In this case, the second channel 34 of the degassing path also has a larger cross section than the first channel 33, the third channel 36 and the fourth channel 37 of the degassing path. The second channel 34 of the degassing path typically has a cross section which is 2 to 4 times greater than that of the first channel 33 of the degassing path. This makes it possible to discharge the bubbles efficiently from the first channel 33 to the third channel 36.

With the pump according to the invention thus formed, the hydraulic control fluid is present only in the second part 7. The fluid is thus present and under pressure in the hydraulic chamber 8, the passage channels 23, the duct 27 which connects the hydraulic chamber 8 to the valve 17, and the main channel 26. The fluid is also present at a pressure which is lower than, or equal to, atmospheric pressure, in the remainder of the valve 17 (hollow body 25 and resupply path), in the degassing path, in the emptying chamber 11, and in the emptying channel 12.

By far the most of the air to be degassed is located at the junction between the second part 7 and the dosage body 14, and is discharged via the degassing path, and is located to a lesser extent (or is even non-existent) in the hydraulic chamber 8, and is preferably discharged via the valve 17, and in particular the main channel 26 and the venting passage 32.

The pump according to the invention thus permits efficient and continuous degassing of the air which is present in the hydraulic fluid, and prevents the presence of an excessively large quantity of air bubbles in the hydraulic chamber 8. The output from the pump according to the invention is thus regular, accurate and stable.

It will be appreciated that the invention is not limited to the embodiments described, and variant embodiments can be provided without departing from the context of the invention as defined by the claims.

Figure 2:
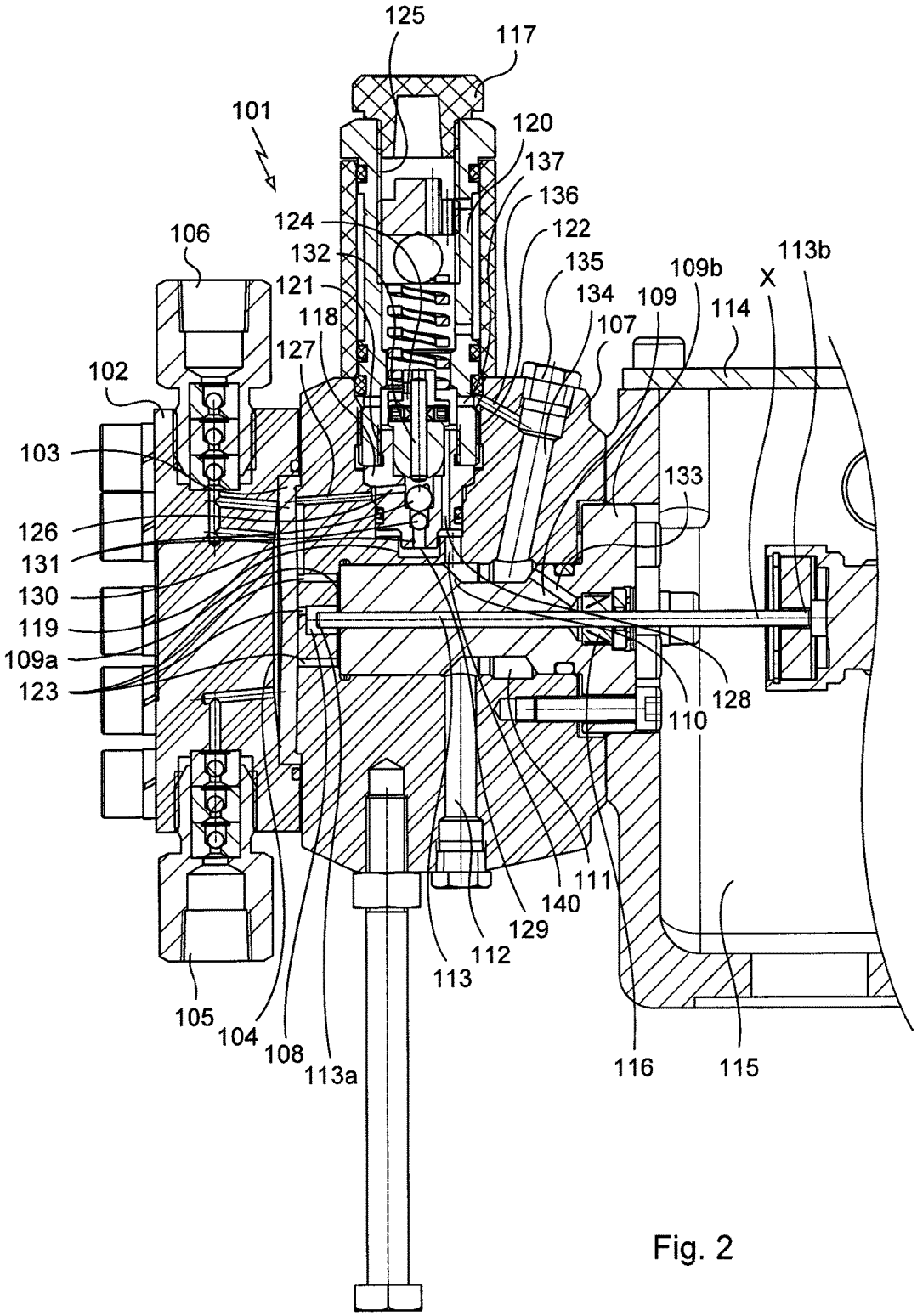
FIG. 2 is a view in cross section of a part of a hydraulically controlled diaphragm pump according to a variant of the invention.

In particular, the pump can have a form other than that described. Thus, with reference to FIG. 2, according to a variant of the invention (the elements which are in common with the embodiment previously described retain the same numbering increased by a hundred), a channel 140 for connection of the emptying chamber 111 to the resupply chamber is provided in the second part 107. Typically, the said connection channel 140 opens out into the low part of the resupply path, in this case into the resupply volume 129. This does not detract excessively from the good degassing via the degassing path, because of the optimized arrangement between the first channel 133 and the second channel 134 of the said degassing path, which ensures that the air bubbles preferably rise via the second channel 134 rather than via the connection channel 140.

The degassing path can also have a form altogether different from that indicated: the said path can thus comprise a different number of channels, and the said channels can be oriented differently. For example the second channel can extend vertically or extend transversely in the direction of the valve. The first channel and the second channel can be connected to one another without the intermediary of the emptying chamber. The dedicated degassing means can comprise a plurality of degassing paths.

In addition, the valve can have a form altogether different from that indicated. The valve can thus be a valve as described in application EP 2 394 056 by the present applicant.

The diaphragm can be different from the one described. The diaphragm can thus be a composite diaphragm comprising a thick inner wall surrounded by two thin metal walls as described in applications FR 2 670 537 and FR 2 934 332 by the applicant.

The pump can also comprise a device for detection of rupture of the diaphragm.

The valve can comprise any known device for degassing of the hydraulic control fluid other than the venting passage described.

The invention claimed is:

1. A hydraulically controlled diaphragm pump comprising:

a dosage head (1; 101) comprising a first part (2; 102) with a pumping chamber (3; 103), and a second part (7; 107) in which there is provided a hydraulic chamber (8; 108) which is filled with a hydraulic control fluid, and is separated from the pumping chamber by a diaphragm (3; 103);

a dosage body (14; 114) comprising means for driving a piston (13; 113) of the pump in translation in the hydraulic chamber according to an axis of translation (X);

at least one seal (16; 116) arranged on the piston at a junction between the second part and the dosage body;

a pressure regularization valve (17; 117) in the vicinity of a highest point of the hydraulic chamber in the position of the pump in service, the valve having a hollow body (25; 125) which is in communication with the hydraulic chamber via a flap valve (24; 124) which opens in a direction going from the hydraulic chamber towards the hollow body;

degassing means which are dedicated to the degassing of the hydraulic control fluid, said degassing means comprising at least one degassing path (33, 34, 36, 37; 133, 134, 136, 137) which extends in the second part in a manner which is non-parallel to the axis of translation, such that a first end of the path which forms a lowest point of said path opens out in an area near a junction between the piston and the at least one seal arranged on the piston at a junction between the second part and the dosage body, and a second end of the path which forms a highest point of said path opens out into the valve body.

2. The pump according to claim 1, wherein the at least one degassing path has a cross section which is globally larger than that of channels which connect the hydraulic chamber (8; 108) to the pressure regularization valve (17; 117).

3. The pump according to claim 1, wherein the degassing path comprises a plurality of channels (33, 34, 36, 37; 133, 134, 136, 137).

4. The pump according to claim 3, wherein the degassing path comprises:

a first channel (33; 133), one end of two ends of the first channel forms the first end of the degassing path, the first channel extending transversely relative to the axis of translation;

a second channel (34; 134) which is connected to the first channel, and extends transversely to the axis of translation;

a third channel (36; 136), which is connected to the second channel, and extends transversely relative to the axis of translation;

a fourth channel (37; 137) with an end which is connected to the third channel, and an end which defines the second end of the degassing path.

5. The pump according to claim 4, wherein the second channel (34; 134) extends in a direction opposite the pressure regularization valve (17; 117) and the first channel (33; 133), and the third channel (36; 136) extend in a direction of the pressure regularization valve.

6. The pump according to claim 4, wherein the second channel (34; 134) has a cross section which is larger than a cross section of the first channel (33; 134), a cross section of the third channel (36; 136) and a cross section of the fourth channel (37; 138).

7. The pump according to claim 4, wherein a lower end of the second channel (34; 134) and another end of the two ends of the first channel (33; 133) open out into an emptying chamber (11; 111) of the second part (7; 107).

8. The pump according to claim 7, wherein the lower end of the second channel (34; 134) opens out into the emptying chamber (11; 111) in an upper part of said emptying chamber, at the same level as another end of the two ends of the first channel (33; 133).

9. The pump according to claim 8, wherein the low end of the second channel (34; 134) opens out above another end of the two ends of the first channel (33; 133).

* * * * *